US010874184B2

(12) United States Patent
Mulford

(10) Patent No.: US 10,874,184 B2
(45) Date of Patent: Dec. 29, 2020

(54) UMBRELLA FRAME STABILIZER SYSTEM

(71) Applicant: David Mulford, Woodbridge, NJ (US)

(72) Inventor: David Mulford, Woodbridge, NJ (US)

( * ) Notice: Subject to any disclaimer, the term of this patent is extended or adjusted under 35 U.S.C. 154(b) by 0 days.

(21) Appl. No.: 16/797,777

(22) Filed: Feb. 21, 2020

(65) Prior Publication Data

US 2020/0187608 A1 Jun. 18, 2020

Related U.S. Application Data

(63) Continuation-in-part of application No. 16/167,930, filed on Oct. 23, 2018, now abandoned.

(60) Provisional application No. 62/575,730, filed on Oct. 23, 2017.

(51) Int. Cl.
*A45B 25/22* (2006.01)
*A45B 25/00* (2006.01)

(52) U.S. Cl.
CPC ..... *A45B 25/22* (2013.01); *A45B 2025/003* (2013.01); *A45B 2200/1018* (2013.01)

(58) Field of Classification Search
CPC ..... A45B 25/22; A45B 2025/003
See application file for complete search history.

(56) References Cited

U.S. PATENT DOCUMENTS

| | | | | |
|---|---|---|---|---|
| 5,131,422 | A | 7/1992 | Aronov | |
| 5,277,212 | A | 1/1994 | Aronov | |
| 5,433,233 | A | 7/1995 | Shiran et al. | |
| 5,794,637 | A | 8/1998 | Figueroa | |
| 5,842,493 | A | 12/1998 | Yakubisin | |
| 6,345,637 | B1 | 2/2002 | Ko | |
| 8,656,937 | B1 | 2/2014 | Minasi et al. | |
| 8,939,163 | B2 | 1/2015 | Gray | |
| 9,526,306 | B2 | 12/2016 | Fitzgerald et al. | |
| 9,713,368 | B1 * | 7/2017 | Kuelbs | A45B 25/00 |
| 2005/0236024 | A1 | 10/2005 | Wu | |
| 2013/0019914 | A1 | 1/2013 | Tung | |
| 2014/0283888 | A1 | 9/2014 | Gray | |
| 2019/0116949 | A1 | 4/2019 | Mulford | |

FOREIGN PATENT DOCUMENTS

| | | | |
|---|---|---|---|
| CA | 2803515 | A1 | 7/2014 |
| CN | 201332767 | Y * | 10/2009 |
| CN | 105495901 | A * | 4/2016 |
| DE | 202005012819 | U1 | 11/2005 |

(Continued)

*Primary Examiner* — David R Dunn
*Assistant Examiner* — Danielle Jackson
(74) *Attorney, Agent, or Firm* — Gearhart Law LLC

(57) ABSTRACT

An umbrella frame stabilizer system configured to maintain frame integrity of an umbrella is described. The system includes the umbrella, a removable light component configured to be housed in a shaft of the umbrella, and a removable stabilizer device coupled to a runner of the umbrella. The device includes a removable attachment that includes at least one movable appendage and at least one matching appendage configured to couple to the at least one movable appendage. The device also includes a housing coupled to the removable attachment, at least one deformable linking member comprises a stretchable material and is at least partially contained within the housing, and at least one ring coupled to a first end of the at least one deformable linking member.

19 Claims, 11 Drawing Sheets

(56) References Cited

FOREIGN PATENT DOCUMENTS

| | | | | |
|---|---|---|---|---|
| DE | 102014016804 | A1 | 5/2016 | |
| EP | 172408 | A1 | 5/1997 | |
| EP | 1603421 | A1 | 12/2005 | |
| EP | 2425737 | A1 | 3/2012 | |
| EP | 2809192 | A1 | 12/2014 | |
| FR | 2991855 | B1 | 6/2014 | |
| FR | 3085108 | A1 * | 2/2020 | ..... A45B 25/22 |
| GB | 2252040 | A | 7/1992 | |
| WO | 9220388 | A1 | 11/1992 | |
| WO | 2017070937 | A1 | 5/2017 | |

* cited by examiner

34

UMBRELLA FRAME STABILIZER SYSTEM

CROSS-REFERENCE TO RELATED APPLICATIONS

This application is a U.S. Continuation-in-Part patent application that claims priority to U.S. Non-Provisional patent application Ser. No. 16/167,930 filed on Oct. 23, 2018, which claims priority from U.S. Provisional Application 62/575,730 filed on Oct. 23, 2017, the entire contents of which are hereby incorporated by reference.

FIELD OF THE EMBODIMENTS

The field of the invention and its embodiments relate to an umbrella frame stabilizer system configured to maintain frame integrity of an umbrella. In particular, the present invention and its embodiments provide an umbrella frame stabilizer system configured to maintain frame integrity of the umbrella that includes the umbrella, a removable light component configured to be housed in a handle of the umbrella, and a removable stabilizer device coupled to a runner of the umbrella.

BACKGROUND OF THE EMBODIMENTS

Umbrellas are widely used and meant to protect people from a wide variety of elements, including rain, snow, wind, and sunlight. Umbrellas may be both portable and stationary. Portable umbrellas may comprise light-weight materials and a minimum amount of structure for ease of transportation. However, such materials may result in the umbrella's moving parts being destroyed when exposed to unpredictable high winds to an extent that the umbrella is no longer usable.

Numerous solutions have been posed to this problem. However, the attempts by others result in shortcomings, which the instant invention addresses. For example, some solutions provide a permanent attachment to the umbrella. However, such attachment is bulky, cumbersome, and is not removable, resulting in a lack of portability for the umbrella.

Further, when engaging with the umbrella, an illumination source is typically needed. The only solution to address this may include the user holding an additional light source, such as a flashlight or a cell phone. However, this may be difficult if the user is already holding the umbrella and/or walking an animal.

Thus, a need exists for an umbrella frame stabilizer system configured to maintain frame integrity of the umbrella that includes the umbrella, a removable light component configured to be housed in a handle of the umbrella, and a removable stabilizer device coupled to a runner of the umbrella.

Review of Related Technology:

U.S. Published Patent Application No. 2014/0283888 pertains to an umbrella anti-inversion apparatus including a removable cuff and a plurality of removable and adjustable straps. The cuff is attached around an umbrella shaft and the straps extend radially from the strap openings on the adjustable cuff to the umbrella tips to which they are connected. There are adjusting means incorporated onto the straps enabling easy modification of length thereby providing varied tension in each strap for effectively preventing undesirable displacement of the rib outer ends.

U.S. Pat. No. 5,794,637 pertains to a whole umbrella having elongated strings having its inner ends connected to a sliding catch and its outer ends connected to the outer ends of ribs, and a suspender means having its lower ends connected to said elongated strings and its upper ends connected to the ribs.

U.S. Pat. No. 8,939,163 pertains to an umbrella anti-inversion apparatus comprising a removable cuff and a plurality of removable and adjustable straps. The cuff is attached around an umbrella shaft and the straps extend radially from the strap openings on the adjustable cuff to the umbrella tips to which they are connected. There are adjusting means incorporated onto the straps enabling easy modification of length thereby providing varied tension in each strap for effectively preventing undesirable displacement of the rib outer ends.

CA 2,803,515 pertains to an umbrella system that provides stability to an umbrella to prevent it from inversion or damage in strong wind conditions. The umbrella includes guidelines that may be stored in the umbrella handle, and may include a spring stored in the handle for retracting a dispensed length of the guidelines. The guidelines may be secured to the canopy of the umbrella or to the ribs of the umbrella. When the umbrella is in an open position, the guidelines may be extended from the handle to the perimeter of the canopy. The guidelines provide a downward force to the umbrella canopy such that when there are strong winds, the umbrella does not invert due to the guidelines pulling down on the canopy. The guidelines may also be stored within the ribs of the umbrella. Clips may also be used to secure one end of the guidelines to the canopy.

U.S. Pat. No. 8,656,937 pertains to an outdoor umbrella stabilizer system for preventing wind damage to an outdoor umbrella having a plurality of cords, a plurality of clips and a means of securing the cords to a weighted object. The stabilizer system flexibly maintains the canopy in position, preventing strong winds from catching the canopy and twisting, warping, contorting, buckling or deforming the umbrella, thereby stabilizing the outdoor umbrella. The stabilizer system installs on many styles of outdoor umbrellas, including a cantilever, a beach umbrella, a deck or patio umbrella, a center pole or vertical pole of the umbrella unnecessary for installation. The stabilizer system has a sac containing ballast as a weighted object. The cords attach to the sac. For an umbrella accommodated by a table having a center hold for the umbrella, the table is the weighted object, the cords attaching to the legs.

U.S. Pat. No. 5,433,233 pertains to a whole umbrella including a central shaft, a plurality of fabric support ribs extending outwardly from the central shaft, a fabric cover associated with the fabric support ribs, a plurality of rib support elements for supporting the fabric support ribs and a plurality of detachable attachment elements, each operative to detachably attach a rib support element onto a fabric support rib, whereby in response to strong winds or other forces, detachment occurs, thereby preventing breakage of the support ribs.

Various umbrella stabilizer systems are known in the art. However, their structure and means of operation are substantially different from the present disclosure, as the other inventions fail to solve all the problems taught by the present disclosure.

SUMMARY OF THE EMBODIMENTS

The present invention and its embodiments relate to an umbrella frame stabilizer system configured to maintain frame integrity of an umbrella. In particular, the present invention and its embodiments provide an umbrella frame stabilizer system configured to maintain frame integrity of the umbrella that includes the umbrella, a removable light component configured to be housed in a handle of the umbrella, and a removable stabilizer device coupled to a runner of the umbrella.

A first embodiment of the instant invention describes an umbrella frame stabilizer system configured to maintain frame integrity of an umbrella. The umbrella frame stabilizer system includes: the umbrella, a removable light component configured to be housed in a handle of the umbrella, and a removable stabilizer device coupled to a runner of the umbrella. The removable stabilizer device includes a removable attachment. In some examples, the removable attachment comprises a rubber material. The removable attachment comprises at least one movable appendage and at least one matching appendage configured to be coupled to the at least one movable appendage. The removable stabilizer device also includes a housing coupled to the removable attachment.

Moreover, the removable stabilizer device also includes at least one deformable linking member that comprises a stretchable material and is at least partially contained within the housing. In some examples, the housing is coupled to the removable attachment with a fastener. In some examples, the housing is circular in shape and comprises at least one flat surface. Further, the removable stabilizer device may also include at least one rotatable spool configured to be fitted within the housing. In some examples, the at least one rotatable spool is coupled to the at least one deformable linking member. In further examples, the at least one rotatable spool is a spring-activated component.

According to some examples, the at least one deformable linking member is retractable into the housing. In other examples, the at least one deformable linking member is coupled to a spring at a second end of the at least one deformable linking member. The removable stabilizer device may also include at least one ring coupled to a first end of the at least one deformable linking member.

A second embodiment of the instant invention describes an umbrella frame stabilizer system configured to maintain frame integrity of an umbrella. The umbrella frame stabilizer system includes the umbrella, a removable light component configured to be housed in a handle of the umbrella, and a removable stabilizer device coupled to a runner of the umbrella. The removable stabilizer device includes a removable attachment. The removable attachment includes at least two movable appendages and at least two matching appendages configured to couple to the at least two movable appendages.

The removable stabilizer device also includes a housing coupled to the removable attachment. According to some examples, the housing is circular and includes at least one flat surface. In other examples, the housing contains a circular cavity and at least two rotatable spring-activated components fitted within the circular cavity. In some examples, the housing comprises one or more openings directed between approximately 135 degrees to approximately 225 degrees with respect to one another. The first deformable linking member and the second deformable linking member may extend through the openings in the housing.

Moreover, the removable stabilizer device may include a first rotatable spring-activated component of the at least two rotatable spring-activated components coupled to a first deformable linking member of the at least two deformable linking members. The first deformable linking member is coupled to a first spring at a second end of the first deformable linking member. Further, the removable stabilizer device may include a second rotatable spring-activated component of the at least two rotatable spring-activated components coupled to a second deformable linking member of the at least two deformable linking members. The second deformable linking member may be coupled to a second spring at a second end of the second deformable linking member.

In other examples, the at least two deformable linking members may be at least partially contained within the circular cavity of the housing. According to some examples, the least two deformable linking members are automatically retractable into the housing when the runner moves in a first direction to close the umbrella. Moreover, according to additional examples, the at least two deformable linking members are automatically extended when the runner moves in a second direction to open the umbrella.

Furthermore, the removable stabilizer device may also include a first deformable ring coupled to a first end of the first deformable linking member and a second ring deformable coupled to a first end of the second deformable linking member.

Additionally, the umbrella frame stabilizer system may further comprise an adapter component having a first side disposed opposite a second side. The first side of the adapter component is configured to be threadedly affixed to a shaft of the umbrella. The second side of the adapter component is configured to be threadedly affixed to the handle of the umbrella.

The removable light component comprises a first portion disposed opposite a second portion and a middle portion located between the first portion and the second portion. The first portion of the removable light component comprises a first side disposed opposite a second side and a body located between the first side and the second side. The first side of the first portion comprises a threaded protrusion having a first width smaller than a second width of the second side of the first portion such that the first side is configured to be received by the second side of the adapter component. The first side of the first portion may also be configured to receive a cord therein. In other examples, the second side of the first portion is threaded.

In additional examples, the middle portion of the removable light component comprises a first side disposed opposite a second side and a body located between the first side and the second side. The first side of the middle portion includes a first protrusion having a first width such that the first protrusion may be received by a recession on the second side of the first portion. Additionally, the second side of the middle portion comprises a second protrusion having a second width such that the second protrusion may be received by a recession located on a first side of the second portion. It should be appreciated that the first width is smaller than the second width. Moreover, according to examples, the body houses a light. In some examples, the light may be a light emitting diode (LED) light.

In further examples, the second portion of the removable light component may comprise a first side disposed opposite a second side and a body located between the first side and the second side. The first side of the second portion may comprise a threaded portion configured to engage a second threaded side of the first portion of the removable light component.

A third embodiment of the instant invention describes a removable stabilizer device coupled to a runner of an umbrella and configured to maintain frame integrity of the umbrella. The device includes a removable attachment. The removable attachment includes at least two movable appendages and at least two matching appendages configured to couple to the at least two movable appendages. According to some examples, each of the at least two movable appendages comprise a rubber material or a plastic material. The plastic material may be polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), and/or high impact polystyrene (HIPS) and polycarbonate (PC), among other materials not explicitly listed herein.

The device also includes a housing coupled to the removable attachment. The housing is circular and includes at least one flat surface. Moreover, the housing contains a circular cavity and at least two rotatable spring-activated components fitted within the circular cavity.

Further, the device also includes a first rotatable spring-activated component of the at least two rotatable spring-activated components coupled to a first deformable linking member of the at least two deformable linking members. The first deformable linking member is coupled to a first spring at a second end of the first deformable linking member. Moreover, the device includes a second rotatable spring-activated component of the at least two rotatable spring-activated components coupled to a second deformable linking member of the at least two deformable linking members. The second deformable linking member is coupled to a second spring at a second end of the second deformable linking member.

Additionally, the at least two deformable linking members are at least partially contained within the circular cavity of the housing, such that the at least two deformable linking members are automatically retractable into the housing when the runner moves in a first direction to close the umbrella and are automatically extended when the runner moves in a second direction to open the umbrella.

Further, the device also includes a first ring coupled to a first end of the first deformable linking member and a second ring coupled to a first end of the second deformable linking member.

In general, the present invention succeeds in conferring the following benefits and objectives.

It is an object of the present invention to provide an umbrella frame stabilizer system configured to maintain frame integrity of an umbrella.

It is an object of the present invention to provide the umbrella frame stabilizer system configured to maintain frame integrity of the umbrella that includes the umbrella, a removable light component configured to be housed in a handle of the umbrella, and a removable stabilizer device coupled to a runner of the umbrella.

It is an object of the present invention to provide the removable stabilizer device coupled to the runner of the umbrella.

It is an object of the present invention to provide the removable light component within the handle of the umbrella to provide illumination to a user engaging with the umbrella.

It is an object of the present invention to provide a light component within the handle of the umbrella such that the light component may be removed and may be worn by the user.

It is an object of the present invention to provide the light component within the handle of the umbrella such that the light component may be removed and may be worn by an animal.

DESCRIPTION OF THE PREFERRED EMBODIMENTS

Figure 1:
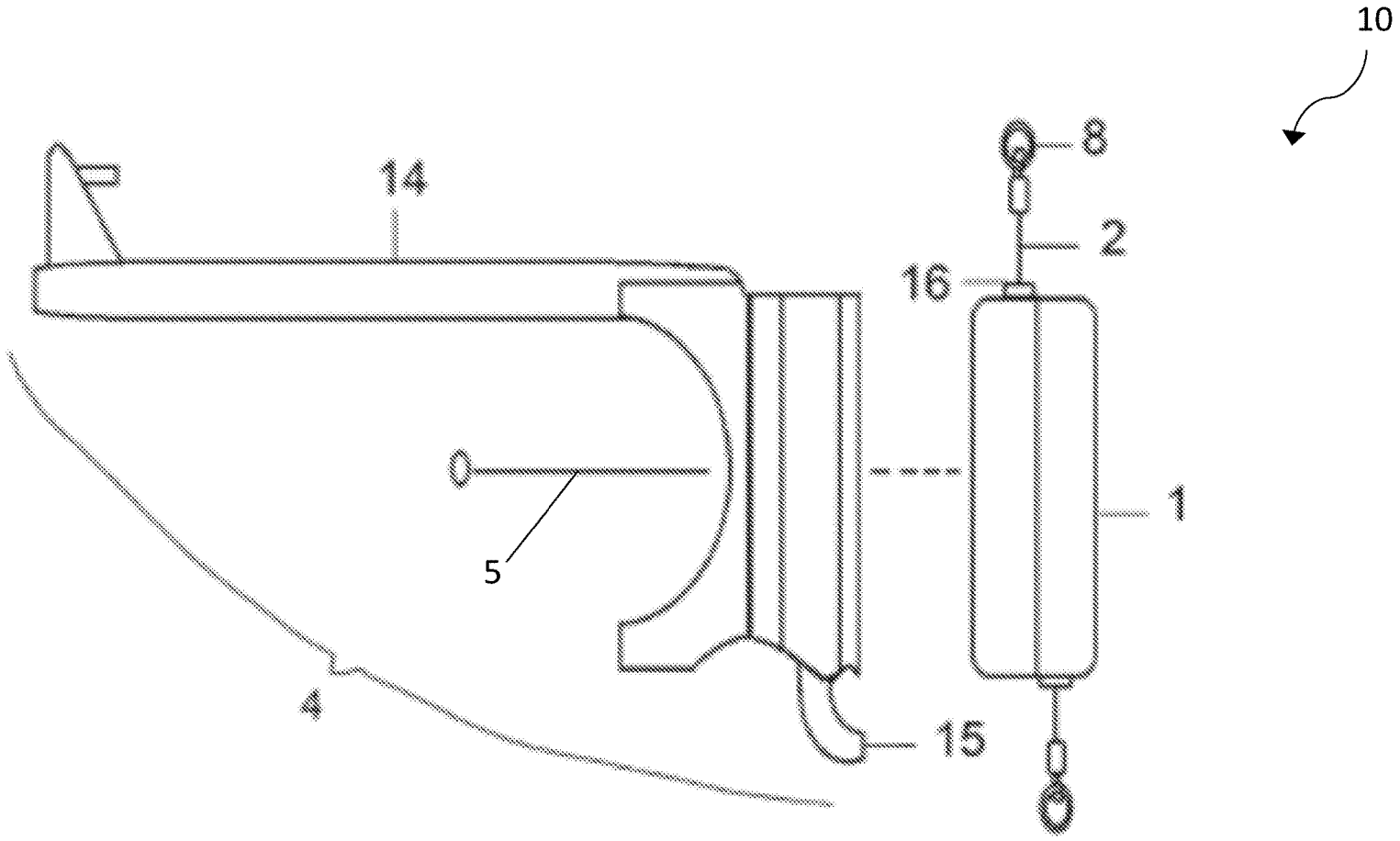
FIG. 1 depicts a side perspective view of a removable stabilizer device for use in an umbrella frame stabilizer system, according to at least some embodiments described herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

According to FIG. 1, a removable stabilizer device 10 for an umbrella 12 (of FIG. 4) is depicted. The removable stabilizer device 10 may include a removable attachment 4. In some examples, the removable attachment 4 may be a removable clasp. The removable attachment 4 may be made of at least one movable appendage 14 and at least one matching appendage 15 configured to couple to the movable appendage 14. The movable appendage 14 may include a strap. The matching appendage 15 may include a hook.

The movable appendage 14 may interact with the matching appendage 15 at multiple positions (such as through a variety of holes on the movable appendage 14) such that different types of umbrellas can be used with the invention. The appendages can be flexible, and be made of rubber or plastic. The plastics may include: polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), and/or high impact polystyrene (HIPS) and polycarbonate (PC), or any combination thereof. It should be appreciated that the listing of plastics described herein is non-exhaustive and other plastics are contemplated by Applicant.

Figure 3:
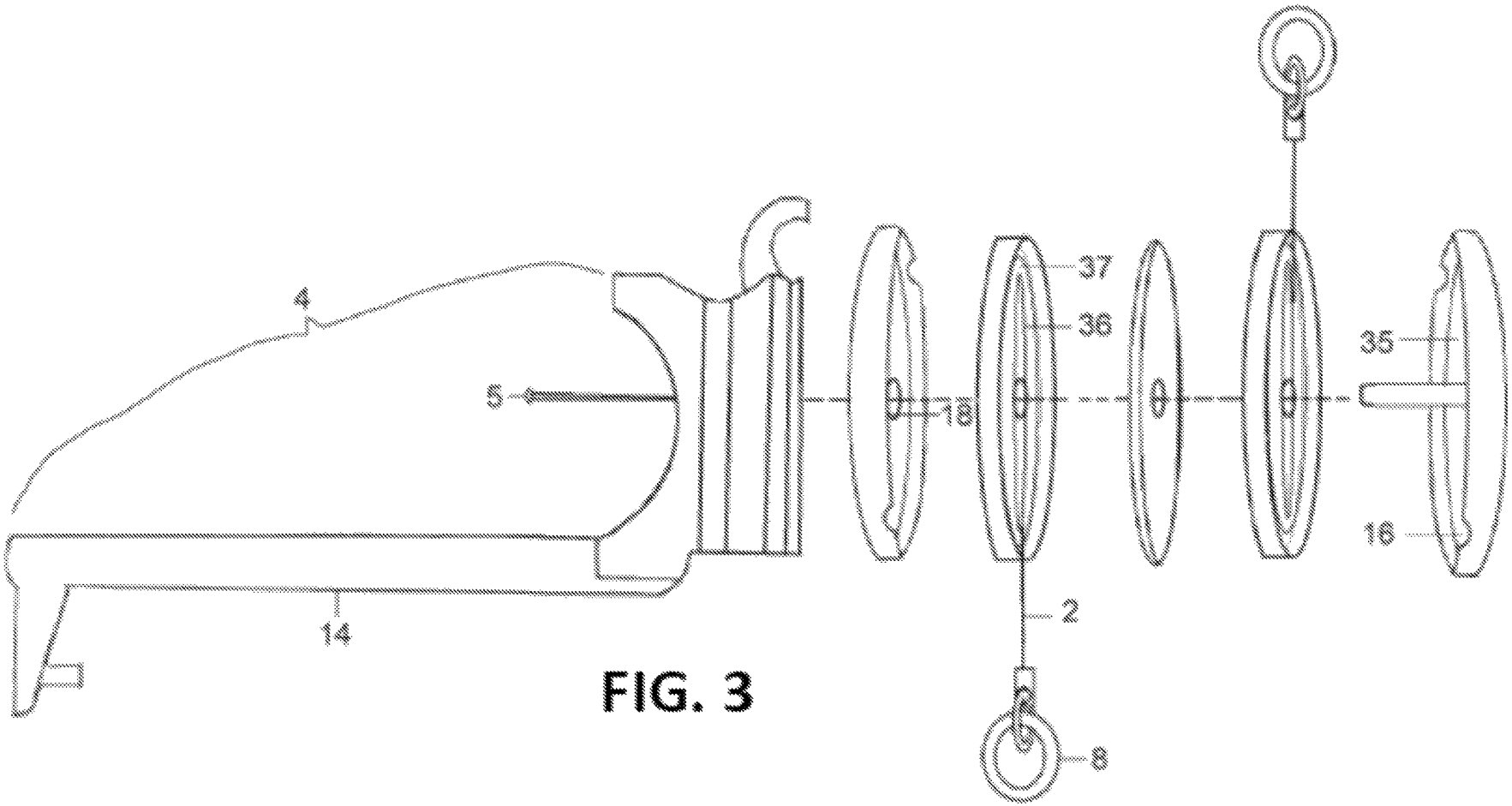
FIG. 3 depicts an exploded view of an interior of a housing and inner components of a removable stabilizer device for use in an umbrella frame stabilizer system, according to at least some embodiments described herein.

The removable attachment 4 can be coupled to a housing 1. The housing 1 can be generally round and coupled to the removable attachment 4 with a fastener 5 (as depicted in FIG. 3). The housing 1 may also contain a circular cavity 35 (as depicted in FIG. 3). In some examples, the cavity 35 may contain a rotatable spool 36 and a spring 37. The cavity 35 can also contain other spools and springs. The spool 36 can be coupled to one end of a linking member 2.

The interior of the housing 1 and the inner components are depicted in FIG. 3. The housing 1 may also include an opening 16 through which the linking member 2 can be pulled though. The openings 16 should be large enough to allow the linking member 2 to be pulled through easily. The openings 16 may be smooth and non-abrasive, such that prolonged use of pulling the linking member 2 back and forth does not abrade and lead to tearing of the linking member 2.

The linking member 2 may be a cord or string with a ring 8 on the end that can be pulled out of the housing 1. The linking member 2 may also be made of a strong, but flexible material that will not snap during wind gusts, but that will also not stretch out over time.

Figure 2:
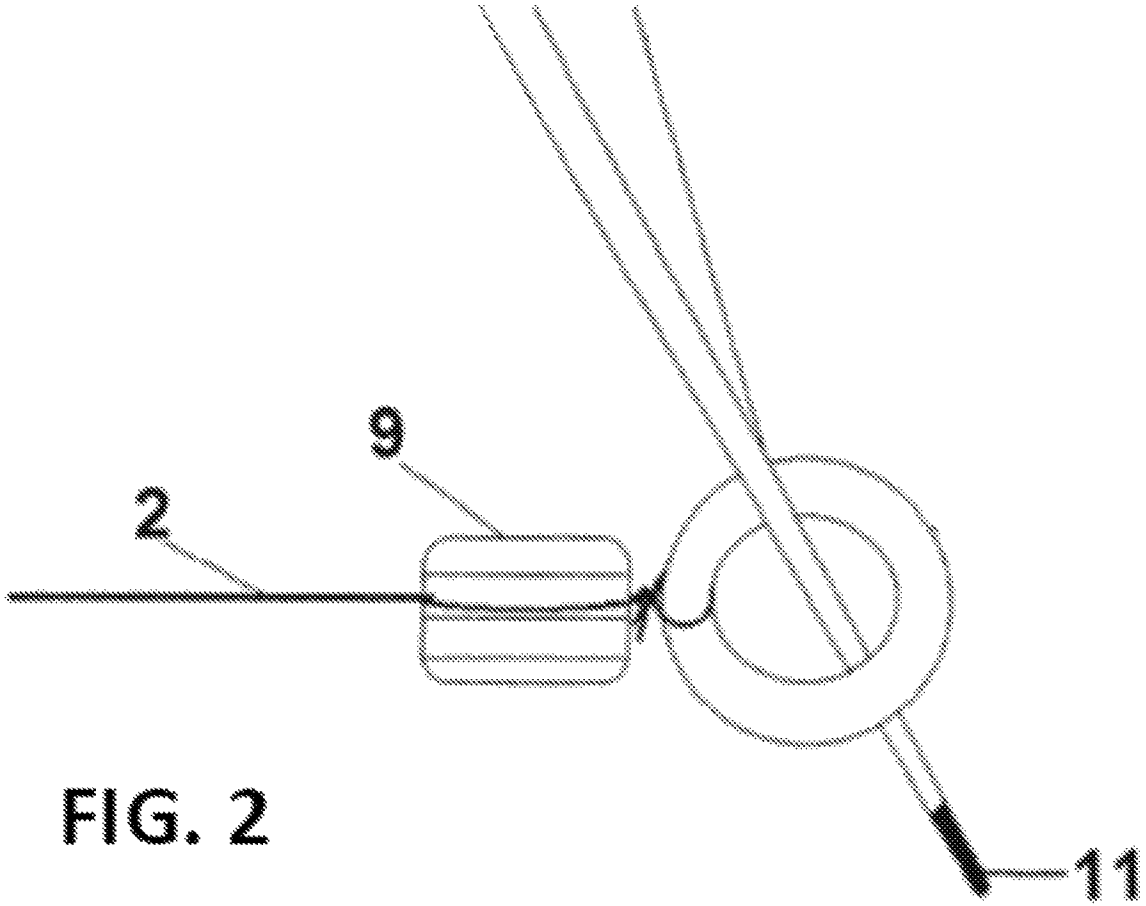
FIG. 2 depicts an interaction between a ring and a tip of an umbrella, according to at least some embodiments described herein.

The linking member 2 can include a stopper 9 (as depicted in FIG. 2) on the outer ends to prevent the members from fully retracting into the housing 1. The stopper 9 can be of various shapes but should be larger than the opening 16. The stopper 9 can be interchangeable and can be used to add style, color, and some individuality to the removable stabilizer device 10.

Figure 4:
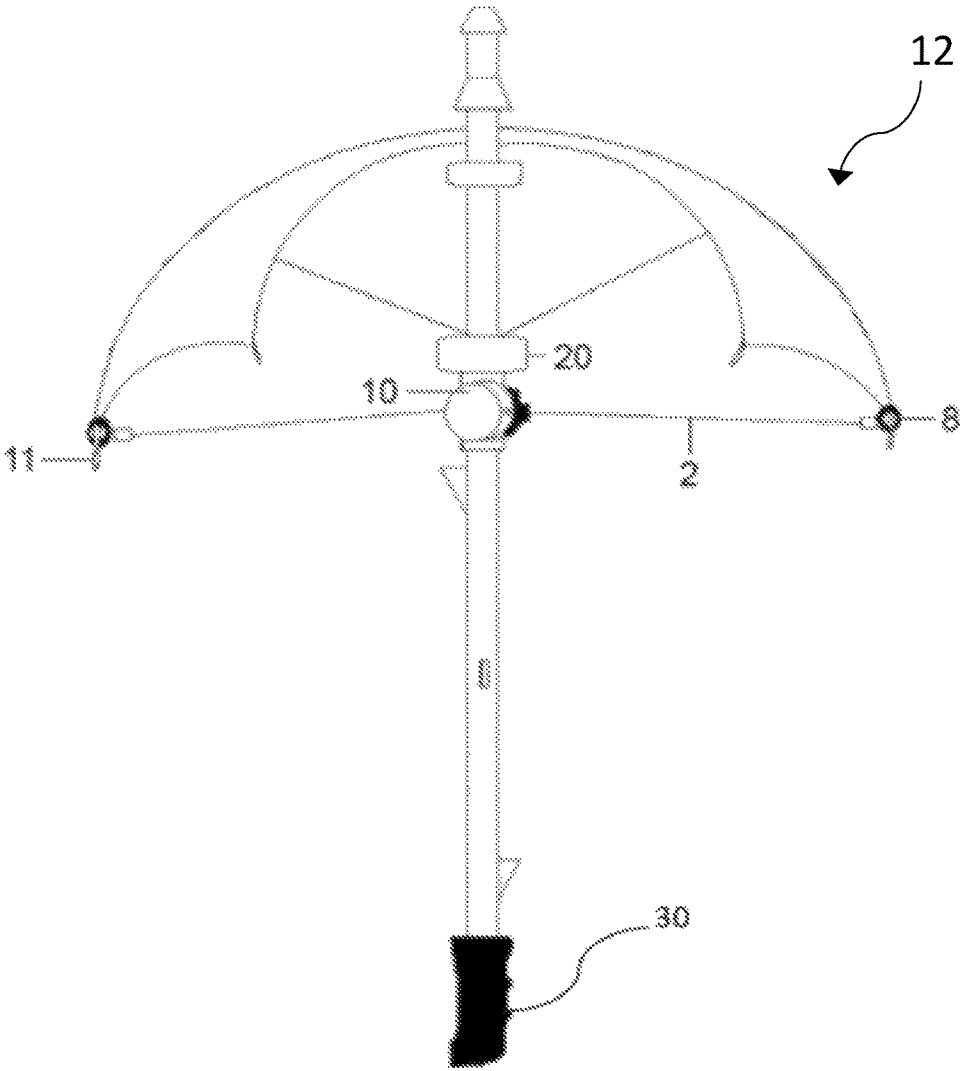
FIG. 4 depicts a perspective view of a removable stabilizer device coupled to an umbrella for use in an umbrella frame stabilizer system, according to at least some embodiments described herein.

The ring 8 may be coupled to the outer end of the linking member 2. The ring 8 should be large enough such that it can easily fit over the umbrella ends 11 (as depicted in FIG. 4), but also small enough such that the ring 8 holds the umbrella ends 11 when a gust of wind hits the umbrella 12 (as depicted in FIG. 4). The ring 8 can be removable and interchangeable with other style of rings. The ring 8 can be changed out in order to fit over a specific umbrella end 11. The ring 8 can also be made of a flexible material, possibly rubber or plastic. FIG. 2 shows a close up of the ring 8 coupled with the umbrella end 11.

As seen in FIG. 1, it is beneficial to have the linking member 2 extend through the opening 16 in the housing 1 with the opening 16. The housing 1 may include a number of the openings 16 and the linking members 2. For example, another linking member may extend through another opening in the housing 1. The openings (16 and another) may be separated by approximately 135 degrees and approximately 225 degrees from each other. As used herein, the term "approximately" defines an angle or other angle(s) formed within several degrees plus or minus of 135 degrees to 225 degrees. This allows the linking members (2 and another) to be attached in various configurations to the ends (11 and another).

Since there is no umbrella standard about the spacing and density of the umbrella ends 11, the direction of the openings (16 and others), the lips of the openings (16 and others) and the flexibility of the linking members (2 and others) allow the device 10 to be paired with any umbrella 12. In another embodiment, the outer ends of the linking members (2 and others) can be split into multiple ends with multiple rings, each of the rings attaching to an individual umbrella tip. This configuration would add even more structure to the umbrella during windy conditions, and prevent unnecessary space consumption by the linking member 2 underneath the umbrella 12.

Figure 6:
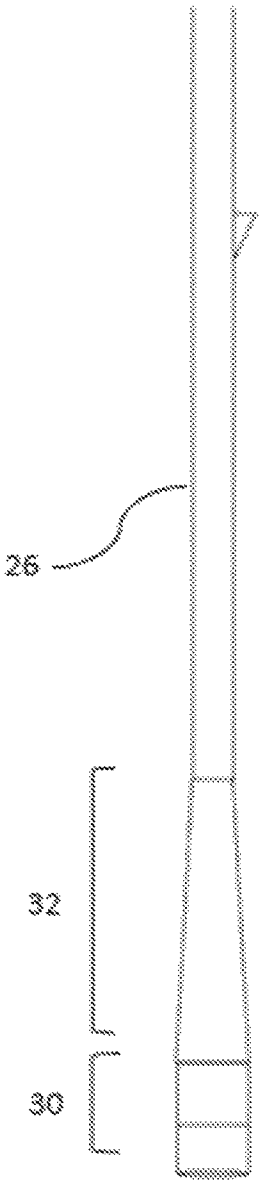
FIG. 6 depicts a perspective view of a shaft of an umbrella affixed to an adapter component, the adapter component being affixed to a handle of the umbrella, the handle housing a removable light component, according to at least some embodiments described herein.
Figure 7:
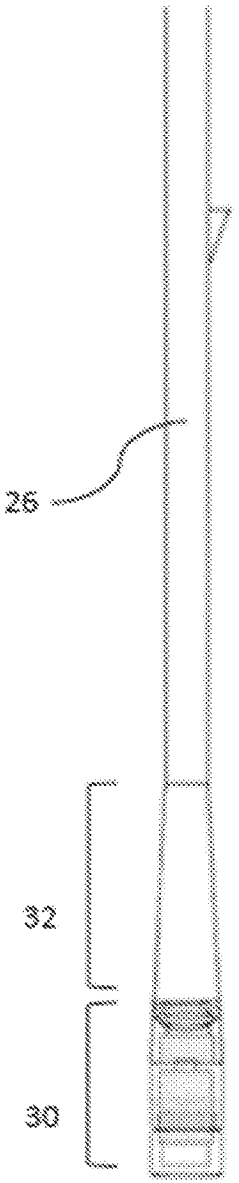
FIG. 7 depicts an interior perspective view of a handle of the umbrella, the handle housing a removable light component, according to at least some embodiments described herein.

As further seen in FIG. 4, the removable stabilizer device 10 can be placed on a central portion of the umbrella 12 preferably on a shaft 26 (as depicted in FIG. 6 and FIG. 7) or directly on a runner 20 on the shaft 26 (as depicted in FIG. 6 and FIG. 7) of the umbrella 12. The benefit of placing the removable stabilizer device 10 on the runner 20 is that the removable stabilizer device 10 never has to be removed. As the runner 20 moves up and down, the linking member 2 is automatically retracted and pulled out, while the umbrella 12 is opened and closed.

The removable stabilizer device 10 can be attached to any thickness and shape of the runner 20. Attributes of the appendages such as flexibility and stretch-ability allow the removable stabilizer device 10 to be mounted and locked to multiple placements associated with the runner 20. The position of the linking member 2 in relation to the umbrella end 11 allows the linking member 2 to pull the end 11 at such an angle that the linking member 2 bends the end 11 slightly inwards and the flapping of the end 11 is not exacerbated during a wind gust. The removable stabilizer device 10 bolster or replace a function of pre-installed rods in maintaining frame integrity of the umbrella 12 because the pre-installed rods are not attached to the end 11 and do not control or hold the end 11 with sufficient stability during forceful events such as a gust or a wind.

Figure 5:
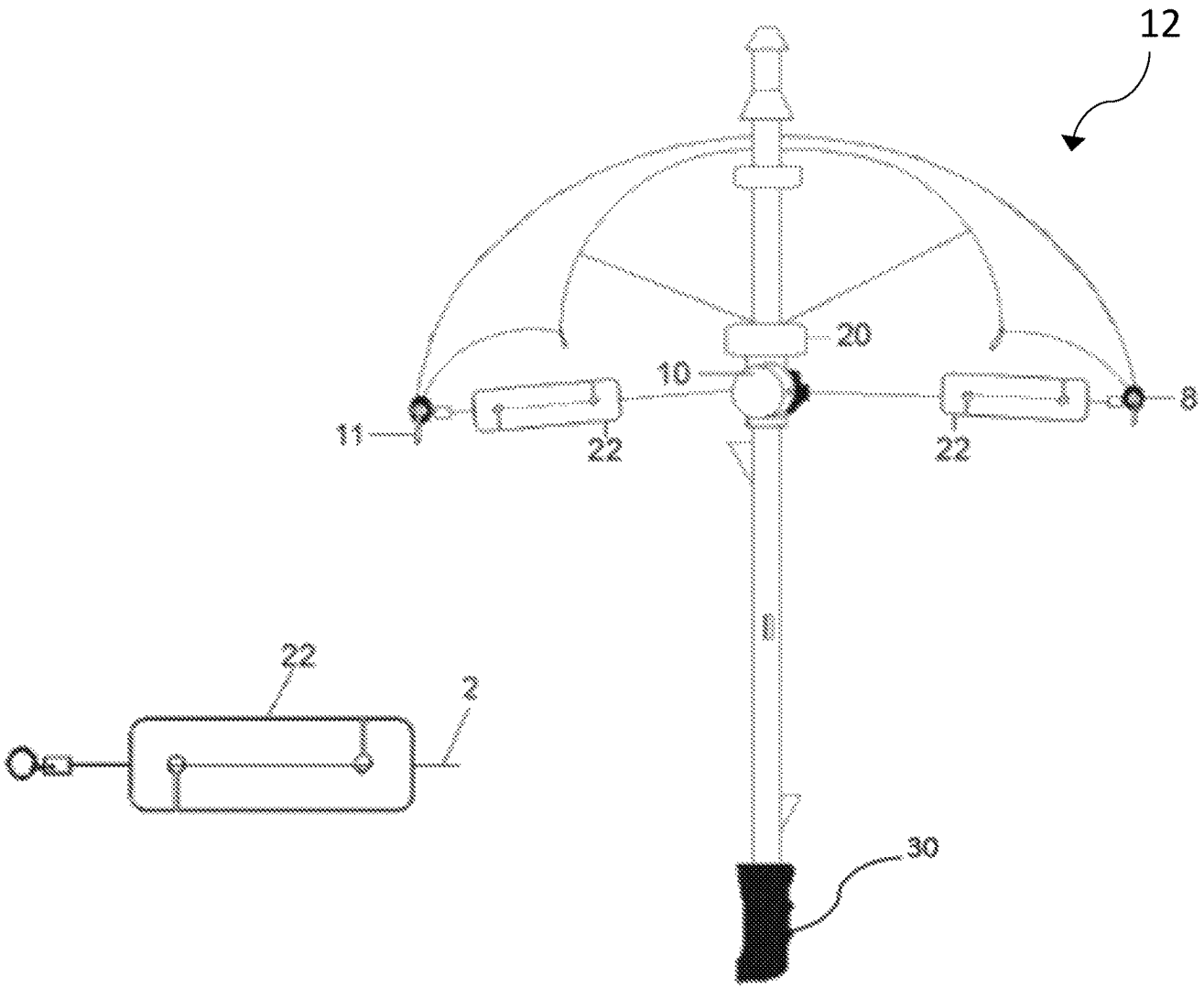
FIG. 5 depicts a perspective view of a string adapter used in addition with the removable stabilizer device coupled to an umbrella, according to at least some embodiments described herein.

As depicted in FIG. 5, the removable stabilizer device 10 may be placed on the shaft 26 (as depicted in FIG. 6 and FIG. 7) or the runner 20 on the shaft 26 (as depicted in FIG. 6 and FIG. 7) of the umbrella 12 (similar to the depiction in FIG. 4). The removable stabilizer device 10 is also easily removable from the shaft 26 or the runner 20 of the umbrella 12. However, a radius of the umbrella 12 may be shorter (or longer) than the linking member 2 connecting the removable stabilizer device 10 to the end 11. In such a scenario, a length adjuster 22 may be utilized to adjust a length of the linking member 2. In an example scenario, an excess portion of the linking member 2 (such as a string) may be wound on the length adjuster 22. As such, a length of the linking member 2 may be adjusted to match the radius of the umbrella 12. The linking member 2 may be connected to the end 11 through the length adjuster 22. As a result, the frame integrity of the umbrella 12 may be maintained during an application of a variety of forces such as wind and others.

Moreover, the removable stabilizer device 10 and all the embodiments mentioned above can be part of a system or a kit with an existing umbrella 12. The kit can be supplied such that it can be retrofitted onto any existing umbrella 12 and the system can be supplied such that it can provided as one piece with the umbrella 12.

Figure 8:
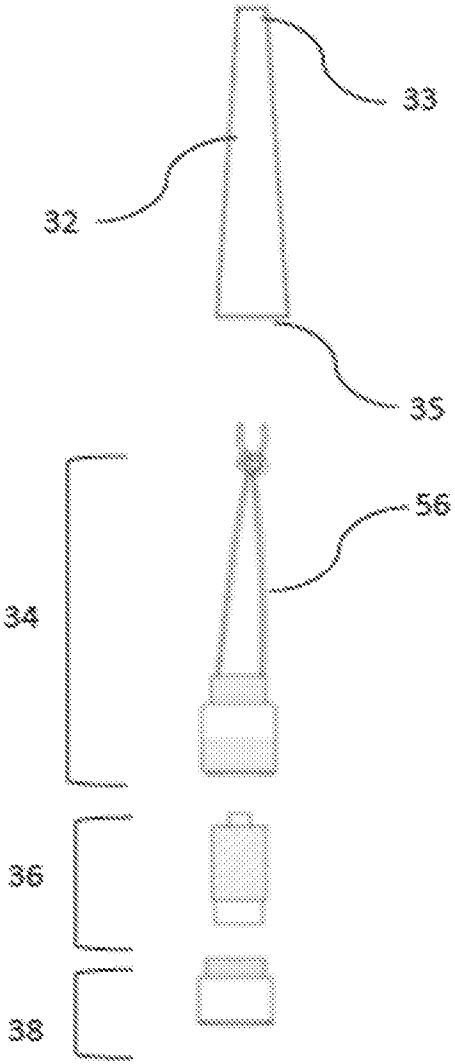
FIG. 8 depicts an exploded view of a removable light component, the removable light component being housed within a handle of an umbrella, according to at least some embodiments described herein.

According to FIG. 6, FIG. 7, and FIG. 8 an adapter component 32 is depicted. In some examples, the adapter component 32 may be conical in shape. However, other shapes not explicitly listed herein are also contemplated. The adapter component 32 may have a first side 33 disposed opposite a second side 35 (as depicted in FIG. 8). The first side 33 of the adapter component 32 is configured to be affixed to a shaft 26 of the umbrella 12. In some examples, the first side 33 of the adapter component 32 is configured to be threadedly affixed to a shaft 26 of the umbrella 12. The second side 35 of the adapter component 32 is configured to be affixed to a handle 30 of the umbrella 12. According to some examples, the second side 35 of the adapter component 32 is configured to be threadedly affixed to the handle 30 of the umbrella 12.

Figure 9:
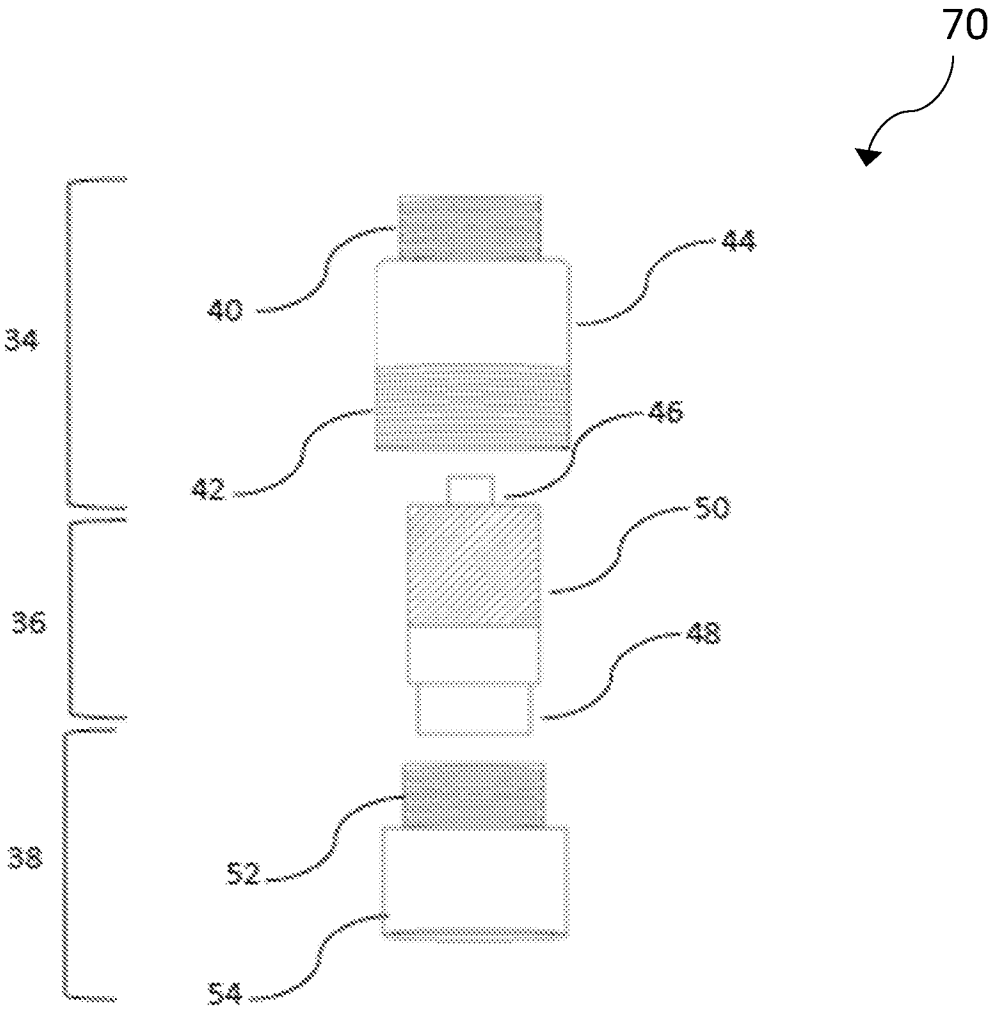
FIG. 9 depicts an exploded view of a removable light component, according to at least some embodiments described herein.

The handle 30 is configured to house a removable light component 70 (as depicted in FIG. 8 and FIG. 9). According to FIG. 8 and FIG. 9, the removable light component 70 comprises a first portion 34 disposed opposite a second portion 38 and a middle portion 36 located between the first portion 34 and the second portion 38. In some examples, the first portion 34, the second portion 38, and the middle portion 36 of the removable light component 70 may be substantially cylindrical in shape. However, it should be appreciated that the shapes of the first portion 34, the second portion 38, and the middle portion 36 will be described in more detail herein. Further, the shapes of the first portion 34, the second portion 38, and the middle portion 36 are not limited to the shapes explicitly described herein.

Additionally, the means by which the first portion 34, the second portion 38, and the middle portion 36 interact to form the removable light component 70 is not limited to any particular means and may include a threaded engagement between at least two of the portions of the removable light component 70, an adhesive engagement between at least two of the portions of the removable light component 70, a magnetic engagement between at least two of the portions of the removable light component 70, an engagement using one or more screws, bolts, fasteners, etc. between the at least two of the portions of the removable light component 70, among other means not explicitly described herein. Further, it should be appreciated that the components of the removable light component 70 may be affixed to one another via the same mechanism. However, in other examples, each of the components of the removable light component 70 may be affixed to one another via two or more mechanisms.

Figure 10A:
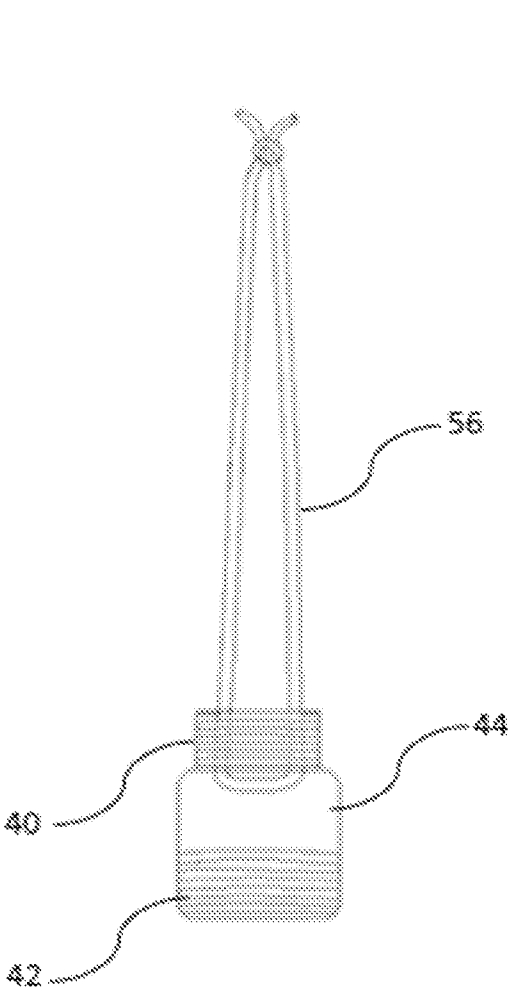
FIG. 10A depicts a perspective view of a first portion of a removable light component, according to at least some embodiments described herein.
Figure 10B:
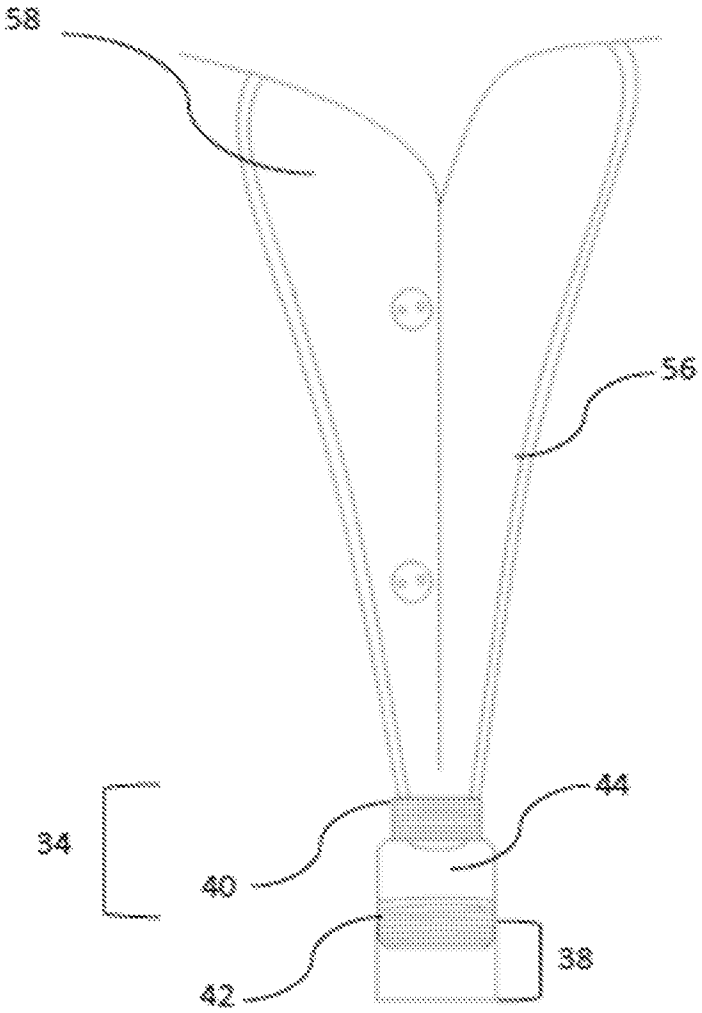
FIG. 10B depicts a perspective view of a first portion and a second portion of a removable light component, according to at least some embodiments described herein.

The first portion 34 (as depicted in FIG. 8, FIG. 9, FIG. 10A, and FIG. 10B) of the removable light component 70 comprises a first side 40 disposed opposite a second side 42 and a body 44 located between the first side 40 and the second side 42. As depicted in at least FIG. 9, the first side 40 of the first portion 34 comprises a threaded protrusion having a first width. The second side 42 of the first portion 34 is threaded and comprises a second width. As shown, the first width is smaller than the second width. Moreover, the first side 40 of the first portion 34 is configured to be received by the second side 35 of the adapter component 32. Further, the first side 40 of the first portion 34 is configured to receive a cord 56 therein (as depicted in FIG. 8, FIG. 10A, and FIG. 10B).

The middle portion 36 (as depicted in FIG. 8 and FIG. 9) of the removable light component 70 comprises a first side 46 disposed opposite a second side 48 and a body 50 located between the first side 46 and the second side 48. The first side 46 of the middle portion 36 comprises a first protrusion having a first width. According to some examples, the first side 46 of the middle portion 36 is configured to be received by a recession on the second side 42 of the first portion 34 of the removable light component 70.

The second side 48 of the middle portion 36 of the removable light component 70 comprises a second protrusion having a second width such that the second protrusion is configured to be received by a recession located on a first side 52 of the second portion 38 of the removable light component 70. The first width is smaller than the second width. Moreover, the body 50 of the middle portion 36 may be configured to house a light. According to some examples, the light may be a light emitting diode (LED). However, the light is not limited to the examples described herein. In some examples, to provide illumination from the light, a user 58 may have to engage a button or a portion of the removable light component 70.

Moreover, the second portion 38 (as depicted in FIG. 8, FIG. 9, and FIG. 10B) of the removable light component 70 may include a first side 52 disposed opposite a second side 54. The second portion 38 of the removable light component 70 may also include a body located between the first side 52 and the second side 54. As depicted, the first side 52 of the second portion 38 may comprise a threaded portion configured to engage the second threaded side 42 of the first portion 34 of the removable light component 70. When the first side 52 of the second portion 38 engages the second threaded side 42 of the first portion 34 of the removable light component 70, the first portion 34 may become affixed to the second portion 38 such that the middle portion 36 is contained within. Moreover, the second side 54 of the second portion 38 may be unthreaded.

According to FIG. 10A, the first portion 34 of the removable light component 70 is depicted. As explained supra, the first side 40 of the first portion 34 of the removable light component 70 may be configured to receive the cord 56 therein. As described herein, the term "cord" may be used to describe any string, cord, strand, twine, etc. made out of any suitable material. As depicted, the cord 56 may be tied such that the cord 56 may be placed around an object, such as a neck of the user 58 or animal. The animal may include any domesticated animal, among other types of animals.

As depicted in FIG. 10B, the cord 56 is depicted as being placed around the neck of the user 58 such that the user 58 may wear the removable light component 70. Once around the neck of the user 58 or the animal, the light within the body 50 of the middle portion 36 of the removable light component 70 may be engaged to provide illumination. It should be appreciated that the light within the body 50 of the middle portion 36 of the removable light component 70 may also be engaged to provide illumination when the removable light component 70 is still affixed within the handle 30 of the umbrella 12. This removable light component 70 is versatile and may be used in numerous ways, such as while the user 58 is walking, running, engaging in sports, while camping, while walking the animal, etc.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An umbrella frame stabilizer system configured to maintain frame integrity of an umbrella, the umbrella frame stabilizer system comprising:

the umbrella;

a removable light component configured to be housed in a handle of the umbrella; and a removable stabilizer device coupled to a runner of the umbrella, the removable stabilizer device comprising:

a removable attachment comprising: at least one movable appendage and at least one matching appendage configured to couple to the at least one movable appendage;

a housing coupled to the removable attachment;

at least one deformable linking member comprising a stretchable material and is at least partially contained within the housing, wherein the at least one deformable linking member is retractable into the housing; and at least one ring coupled to a first end of the at least one deformable linking member.

2. The umbrella frame stabilizer system of claim 1, wherein the removable attachment comprises a rubber material.

3. The umbrella frame stabilizer system of claim 1, wherein the at least one deformable linking member is coupled to a spring at a second end of the at least one deformable linking member.

4. The umbrella frame stabilizer system of claim 1, wherein the housing is circular in shape and comprises at least one flat surface.

5. The umbrella frame stabilizer system of claim 4, wherein the removable stabilizer device further comprises:

at least one rotatable spool configured to be fitted within the housing.

6. The umbrella frame stabilizer system of claim 5, wherein the at least one rotatable spool is coupled to the at least one deformable linking member.

7. The umbrella frame stabilizer system of claim 4, wherein the at least one rotatable spool is a spring-activated component.

8. The umbrella frame stabilizer system of claim 1, wherein the housing is coupled to the removable attachment with a fastener.

9. An umbrella frame stabilizer system configured to maintain frame integrity of an umbrella, the umbrella frame stabilizer system comprising:

the umbrella;

a removable light component configured to be housed in a handle of the umbrella; and a removable stabilizer device coupled to a runner of the umbrella, the removable stabilizer device comprising:

a removable attachment comprising: at least two movable appendages and at least two matching appendages configured to couple to the at least two movable appendages;

a housing coupled to the removable attachment, wherein the housing is circular and includes at least one flat surface, and wherein the housing contains a circular cavity and at least two rotatable spring-activated components fitted within the circular cavity;

a first rotatable spring-activated component of the at least two rotatable spring-activated components coupled to a first deformable linking member of at least two deformable linking members;

a second rotatable spring-activated component of the at least two rotatable spring-activated components coupled to a second deformable linking member of the at least two deformable linking members;

the at least two deformable linking members at least partially contained within the circular cavity of the housing;

a first deformable ring coupled to a first end of the first deformable linking member; and a second ring deformable coupled to a first end of the second deformable linking member.

10. The umbrella frame stabilizer system of claim 9, wherein the first deformable linking member is coupled to a first spring at a second end of the first deformable linking member, and wherein the second deformable linking member is coupled to a second spring at a second end of the second deformable linking member.

11. The umbrella frame stabilizer system of claim 10, wherein the at least two deformable linking members are automatically retractable into the housing when the runner moves in a first direction to close the umbrella, and wherein the at least two deformable linking members are automatically extended when the runner moves in a second direction to open the umbrella.

12. The umbrella frame stabilizer system of claim 9, wherein the housing comprises one or more openings directed between approximately 135 degrees to approximately 225 degrees with respect to one another;

wherein the first deformable linking member extends through a first opening of the one or more openings in the housing; and wherein the second deformable linking member extends through a second opening of the one or more openings in the housing.

13. The umbrella frame stabilizer system of claim 9, wherein the umbrella frame stabilizer system further comprises:

an adapter component having a first side disposed opposite a second side, wherein the first side is configured to be threadedly affixed to a shaft of the umbrella, and wherein the second side is configured to be threadedly affixed to the handle of the umbrella.

14. The umbrella frame stabilizer system of claim 9, wherein the removable light component comprises:

a first portion disposed opposite a second portion; and a middle portion located between the first portion and the second portion.

15. The umbrella stabilizer system of claim 14, wherein the first portion comprises:

a first side disposed opposite a second side; and a body located between the first side and the second side, wherein the first side comprises a threaded protrusion having a first width smaller than a second width of the second side such that the first side is configured to be received by a second side of an adapter component, wherein the first side is configured to receive a cord therein, and wherein the second side of the adapter component is threaded.

16. The umbrella stabilizer system of claim 14, wherein the middle portion comprises:

a first side disposed opposite a second side; and a body located between the first side and the second side, wherein the first side comprises a first protrusion having a first width and configured to be received by a recession on a second side of the first portion, wherein the second side comprises a second protrusion having a second width and configured to be received by a recession located on a first side of the second portion, wherein the first width is smaller than the second width, and wherein the body houses a light.

17. The umbrella frame stabilizer system of claim 14, wherein the second portion comprises:

a first side disposed opposite a second side; and a body located between the first side and the second side, wherein the first side comprises a threaded portion configured to engage a second threaded side of the first portion.

18. A removable stabilizer device coupled to a runner of an umbrella and configured to maintain frame integrity of the umbrella, the removable stabilizer device comprising:

a removable attachment comprising: at least two movable appendages and at least two matching appendages configured to couple to the at least two movable appendages;

a housing coupled to the removable attachment, wherein the housing is circular and includes at least one flat surface, and wherein the housing contains a circular cavity and at least two rotatable spring-activated components fitted within the circular cavity;

a first rotatable spring-activated component of the at least two rotatable spring-activated components coupled to a first deformable linking member of at least two deformable linking members, wherein the first deformable linking member is coupled to a first spring at a second end of the first deformable linking member;

a second rotatable spring-activated component of the at least two rotatable spring-activated components coupled to a second deformable linking member of the at least two deformable linking members, wherein the second deformable linking member is coupled to a second spring at a second end of the second deformable linking member;

the at least two deformable linking members at least partially contained within the circular cavity of the housing, such that the at least two deformable linking members are automatically retractable into the housing when the runner moves in a first direction to close the umbrella and are automatically extended when the runner moves in a second direction to open the umbrella;

a first ring coupled to a first end of the first deformable linking member; and a second ring coupled to a first end of the second deformable linking member.

19. The removable stabilizer device of claim 18, wherein each of the at least two movable appendages comprise a rubber material or a plastic material, and wherein the plastic material is selected from the group consisting of: polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), and high impact polystyrene (HIPS) and polycarbonate (PC).

* * * * *